US005199202A

United States Patent [19]

Musgrave

[11] Patent Number: 5,199,202

[45] Date of Patent: Apr. 6, 1993

[54] LIGHT BOX WITH MULTIPLE IMAGE-FORMING MEANS THEREIN

[76] Inventor: Gary S. Musgrave, 267 27th St., San Francisco, Calif. 94131

[21] Appl. No.: 830,519

[22] Filed: Feb. 3, 1992

Related U.S. Application Data

[63] Continuation of Ser. No. 571,807, Aug. 22, 1990, abandoned.

[51] Int. Cl.[5] ..... G09F 13/12

[52] U.S. Cl. ..... 40/219; 40/900

[58] Field of Search ..... 40/219, 564, 575, 577, 40/900, 611, 615, 152.2, 427, 490; 359/850; 472/58, 63

[56] References Cited

U.S. PATENT DOCUMENTS

| | | | |
|---|---|---|---|
| 1,202,593 | 10/1916 | Scott | 40/219 |
| 2,056,396 | 10/1936 | Gorrie | 40/219 |
| 2,132,472 | 10/1938 | Holm | 40/219 |
| 2,132,473 | 10/1938 | Holm | 40/219 |
| 2,203,244 | 6/1940 | White . | |
| 2,221,889 | 11/1940 | White . | |
| 3,790,771 | 2/1974 | Newman . | |
| 4,202,604 | 5/1980 | Kent et al. | 40/219 X |
| 4,974,354 | 12/1990 | Hembrook, Jr. | 40/546 |

*Primary Examiner*—Kenneth J. Dorner
*Assistant Examiner*—Brian K. Green
*Attorney, Agent, or Firm*—Townsend and Townsend

[57] ABSTRACT

A light box having a pair of mirrors, the outer or front mirror being transparent and the other mirror being opaque and provided with design formed on the reflecting layer of the opaque mirror. The side margins of the opaque mirror are removably received in grooves carried by holders on the inner side surfaces of the light box. The opaque mirror can be placed either parallel to the transparent mirror or can be placed at an acute angle with respect to the transparent mirror. The light box can have a single side provided with mirrors for looking at multiple images of designs by viewing through an opening at the one side of the light box. In another embodiment, the light box can have a plurality of sides with each side having a set of transparent and opaque mirrors so that, regardless of which side is observed by the viewer, a specific design can be observed. Other embodiments of the light box include a light box which is triangular in construction, a light box having a clock design, a light box made in the form of a table, and a light box made in the form of a pedestal or support for a vase or speaker.

7 Claims, 5 Drawing Sheets

FIG. 11
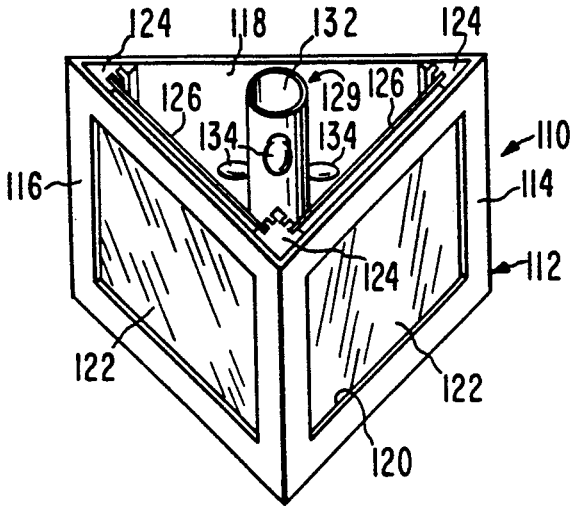
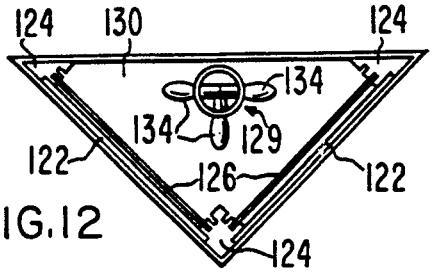
FIG. 12
FIG. 13
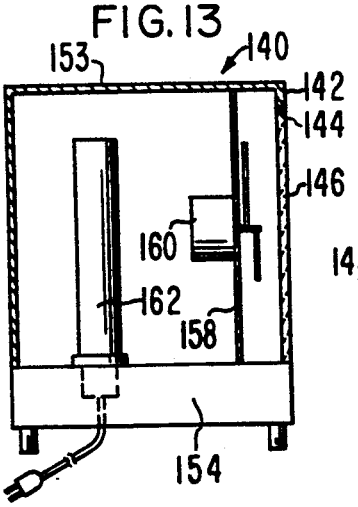
FIG. 14
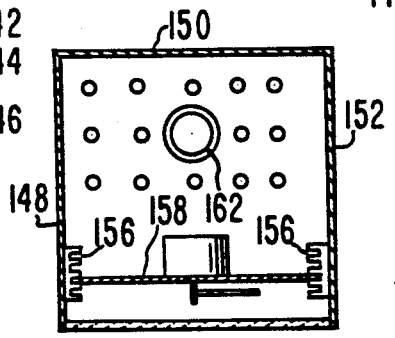
FIG. 15
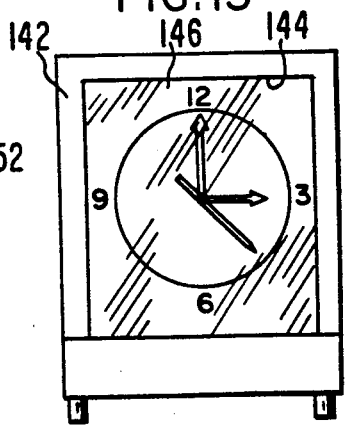

LIGHT BOX WITH MULTIPLE IMAGE-FORMING MEANS THEREIN

This is a continuation of application Ser. No. 07/571,807, filed Aug. 22, 1990, now abandoned.

This invention relates to improvements in structures for forming light images of various designs and, more particularly, to a light box for forming a multiplicity of light images using a combination of mirrors.

BACKGROUND OF THE INVENTION

Light boxes having mirrors for forming a plurality of images have been known and used in the past. Disclosures on this general subject matter are found in U.S. Pat. Nos. 2,203,244 and 2,221,889. Both of these patents teach the use of motors for rocking a first of a pair of mirrors relative to the other mirror about a horizontal axis through the first mirror to generate light images which appear to move at all times during operation of the motors.

In U.S. Pat. No. 2,203,244, a light box is described with a front transparent mirror and a rear opaque mirror, the mirrors having opposed reflecting surfaces, and a complex motor-lever assembly for causing the opposed mirror surfaces to assume different angular positions by continuously moving one of said mirrors relative to the other mirror by way of the motor.

U.S. Pat. No. 2,221,889 uses the same type of complex mirror arrangement and motor drive means for continuously moving one of the mirrors relative to the other mirror. U.S. Pat. No. 2,221,889 improves on the structure of the first patent wherein disappearing indicia are combined with constantly visible indicia. This is accomplished by having part of the reflecting surfaces of the mirrors opaque for the purpose of carrying out a pattern or scheme of any desired arrangement of character or appearance of the indicia.

Another disclosure in the light box field having reflecting surfaces includes U.S. Pat. No. 3,790,772 wherein a light box has mirrored inner wall surfaces with multiple light sources in a light box. Interchangeable exterior wall panels are also carried by the box. The wall panels do not provide for angular arrangement of the mirrored surfaces; thus, the light box of this patent is limited in use as to the light image designs that can be formed with the light box.

By virtue of the limitations and complexity of the prior art structures as exemplified by the above patents, a need exists for improvements in light boxes which simplify the way in which the mirrors are held in operative positions with respect to each other without detracting from the aesthetic designs which can be formed by images of the designs. The present invention satisfies this need.

SUMMARY OF THE INVENTION

The present invention relates to a light box having a pair of mirrors which are spaced apart with the outer or front mirror being transparent and the other mirror being opaque and provided with design etched or formed on the reflecting layer of the opaque mirror. The main feature of the present invention is the way in which the side margins of the opaque mirror are removably received in grooves carried by holders on the inner side surfaces of the light box so that the opaque mirror can be placed either parallel to the transparent mirror or can be placed at an acute angle with respect to the transparent mirror. This can be done quickly and easily because the structure which forms the grooves is simple and rugged in construction and can be coupled to the interior of the light box without interfering with the image-forming action of the mirrors themselves.

By virtue of the simplicity of the structure of the present invention, light boxes of different shapes and configurations can be formed following the teachings of the present invention. For instance, a light box can have a single side provided with mirror structures for looking at multiple images of designs by viewing only through an opening at the one side of the light box. In another embodiment, the light box can have a plurality of sides with each side having a set of transparent and opaque mirrors so that, regardless of which side is observed by the viewer, a specific design can be observed.

Other embodiments of the light box include a light box which is triangular in construction, a light box having a clock design, a light box made in the form of a table, and a light box made in the form of a pedestal or support for a vase or speaker.

The primary object of the present invention is to provide an improved light box having transparent and opaque mirrors therewithin wherein the light box has grooved mounting means for the side margins of the opaque mirror which allows the opaque mirror to be quickly adjusted in parallel with or at an acute angle with respect to the transparent mirror to thereby avoid the complexity of the light box structures of the prior art.

Other objects of this invention will become apparent as the following specification progresses, reference being had to the accompanying drawings for an illustration of several embodiments of the present invention.

BRIEF DESCRIPTION OF THE DRAWINGS

FIG. 11 is a perspective view of another embodiment of the box of the present invention, the light box being in the shape of a triangle;

FIG. 12 is a top plan view of the light box of FIG. 11 with the lid removed;

FIG. 13 is a schematic side elevational view of another embodiment of the light box of the present invention in the form of a clock unit;

FIG. 14 is a top plan view of the light box of FIG. 13;

FIG. 15 is a front elevational view of the light box embodiment of FIGS. 13 and 14;

DETAILED DESCRIPTION OF THE DRAWINGS

Figure 1:
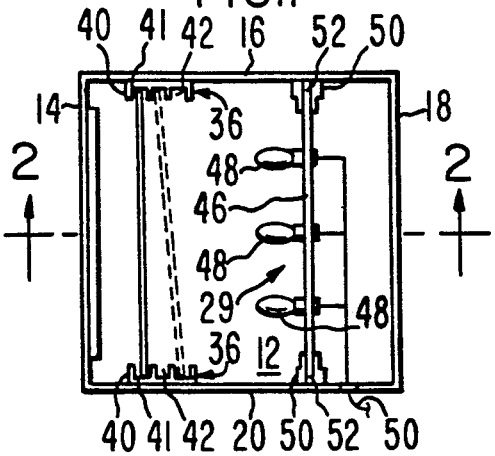
FIG. 1 is a top plan view of a first embodiment of the light box of the present invention showing the lid of the light box removed and illustrating the positions of a pair of space and a light source in the light box.

A first embodiment of the light box having multiple image-forming means of the present invention is denoted by the numeral 10 and includes a support frame comprised of a bottom 12, sides 14, 16, 18 and 20, and an open top 22 which is normally closed by a removable lid 23. Bottom 12 and sides 14, 16, 18 and 20, can be made of any suitable material such as wood, plastic or metal; preferably, the material is plastic to minimize cost and to decrease the weight of the light box.

Figure 2:
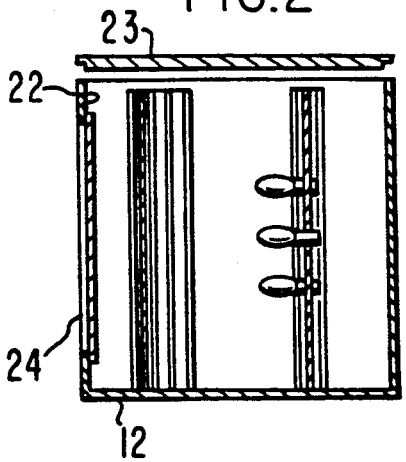
FIG. 2 is a cross-sectional view taken along line 2—2 of FIG. 1.
Figure 3:
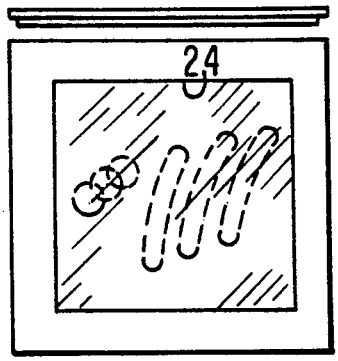
FIG. 3 is a front elevational view of the light box of FIG. 1, illustrating the image viewed from a location exterior the light box when the inner mirror is in the dashed line position of FIG. 1.

Side 14 has an opening 24 therethrough as shown in FIG. 2. A transparent or two-way mirror 26 within the light box is positioned across opening 24, and mirror 26 is secured to the inner surface of side wall 14 in any suitable manner, such as by an adhesive or by fasteners. Light rays passing out of the box through mirror 26 are partially reflected back into the box by the mirror and are partially transmitted through the mirror to an observer outside of the box.

Figure 6:
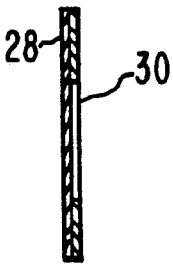
FIG. 6 is cross-sectional view taken along line 6—6 of FIG. 5.

A second, inner opaque mirror 28 is located within the light box 10 in spaced relationship to mirror 26 as shown in FIGS. 1 and 2. Mirror 28 is a full reflecting mirror in that it has a mirrored or coating 30 on the inner surface thereof as shown in FIG. 6. Moreover, a particular design, such as a circle 32 and a bar 34, are formed in the coating 30, and multiple images of the design are formed by the reflecting action of the mirrors 26 and 28 when a light source 29 in the light box is energized. Such multiple images are to be viewed by an observer exteriorly of the light box looking in the direction of transparent mirror 26. The formation and appearance of the images will be discussed hereinafter.

A pair of elongated brackets 36 are mounted on the inner surfaces of side Walls 16 and 20, and each bracket 36 has a mounting plate 41 and parallel ribs 40 on the mounting plate which define spaced, parallel grooves 42 in the brackets for removably receiving the adjacent side marginal edges of inner mirror 28 so as to support the inner mirror in an upright position in which inner mirror 28 is either parallel to mirror 26 or at an acute angle with respect to the mirror 26. The upper ends of grooves 42 are open to allow for removal of inner mirror 28 to permit adjustment of the location of the inner mirror relative to the mirror 26. Typically, the brackets 36 extend upwardly from bottom 12 to a location near the upper edges of the adjacent sides of the light box.

The light source 29 includes a panel 46 provided in light box 10 between mirror 28 and side wall 18 (FIGS. 1 and 2). The panel is generally parallel with side wall 18. Light source 29 can be of any suitable construction. For purposes of illustration, a panel 46 has a number of spaced light bulbs 48 coupled by an electrical lead 51 to a source of electrical power. The light bulbs may be uncolored or colored, and typically Christmas tree light bulbs are suitable for this purpose.

Elongated brackets 50 are secured to the inner surfaces of side walls 16 and 20 and the brackets have respective grooves 52 therein for removably receiving the side marginal edges of panel 46, the grooves being open at the tops thereof so that the panel 46 can enter the grooves and rest on bottom 12 with the light bulbs spaced from mirror 28. The arrangement of the light bulbs on the panel 46 is arbitrary.

In operation, light box 10 has mirror 26 in place across opening 24 in the light box as shown in FIGS. 1 and 2. Mirror 28 will be positioned in grooves 42 such that the mirror 28 will be either parallel to mirror 26 or at an acute angle with respect to mirror 26. Also, mirror 28 can be relatively close to or relatively far from mirror 26 depending on the set of grooves 42 used to receive the side marginal edges of mirror 28. Grooves 42 are made so that mirror 28 can easily be mounted at an acute angle as shown in dashed lines in FIG. 1.

Figure 4:
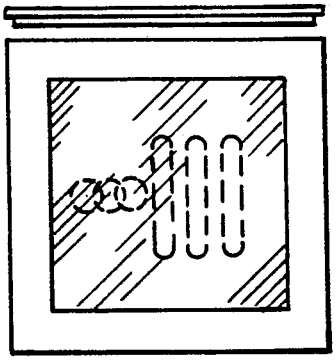
FIG. 4 is a view similar to FIG. 3 but showing the image which is viewable when the inner mirror is in the full line position of FIG. 1.

Light bulbs 48 will be energized to direct light rays to the left when viewing FIG. 1 so that the light rays will pass through the mirrors 26 and 28. With mirror 28 in the full line position of FIG. 1, multiple images of circle 32 and bar 34 will be observable by looking into the light box through mirror 26. To see multiple images of the circle and bar, the line of vision of the eye of the observer must be off-center with respect to the center line of the mirror 26. A person looking head-on at mirror 26 will generally see only a single circle and a single bar. By moving the head to the left or the right or up or down, the images of the circle and bar will appear to multiply and multiple images of circles and bars will appear to extend along straight lines deeper into the interior of the light box. This straight line effect is shown in FIG. 4.

Figure 5:
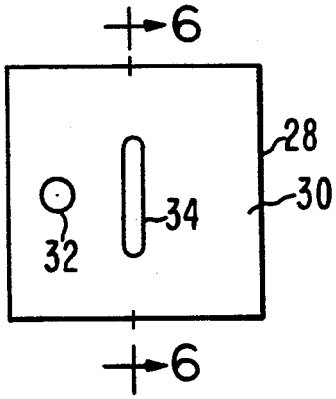
FIG. 5 is a rear elevational view of the inner mirror, showing the way in which the design is etched or formed in the mirrored or reflecting layer of the inner mirror.

If the mirror 28 is at an acute angle with respect to mirror 26, such as in the dashed line position of FIG. 1, the circles and bars will be on a line which appears to bend to the right or to the left, depending upon which side margin of mirror 28 is spaced farther from mirror 26. If the left hand side margin of the mirror 28 is farther from mirror 26 than the right hand side margin, as shown in FIG. 1, the circles and bars will be on respective lines which appear to bend to the right as shown in FIG. 5. Conversely, the circles and bars will be on respective lines which appear to bend to the left if the right hand side margin of mirror 28 is farther from mirror 26 than the left hand side margin. Thus, any desired multiple image design can be formed by properly positioning mirror 28 with respect to mirror 26. Moreover, the adjustability provided by the grooves 42 on brackets 36 allows flexibility in changing the image positions of the designs whatever they may be, such as circle 32 and bar 34. The grooves 42, therefore, provide a holding means for the side margins of mirror 28 as well as to provide, in effect, a pivot means to allow mirror 28 to be changed from the full line position of FIG. 1 to a dashed line position, such as the dashed line position of FIG. 1.

Figure 1A:
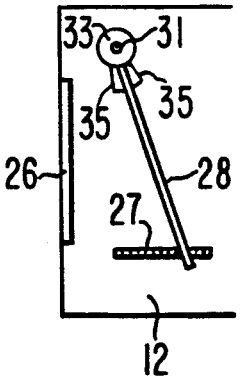
FIG. 1A is a view similar to FIG. 1 but showing an improved pivot for the inner mirror of the light box.

Brackets 36 could be replaced by a pivot means having a pivot pin 31 rotatable about a vertical axis. Pivot pin 31 is coupled to bottom 12 and have a rotatable, tubular member 33 therein (FIG. IA) to mount one side marginal edge portion of mirror 28 for rotation about the vertical axis of pivot pin 31 with the rotatable member 33 having spaced, parallel ribs 35 for forming a groove for receiving the adjacent side marginal edge of mirror 28. A brake or holder 37 could be provided on bottom 12 for frictionally engaging the lower marginal edge portion of mirror 28 to releasably hold the mirror in any one of a number of operative positions at any angle relative to mirror 26, such as the angle shown in FIG. 1A.

Figure 8:
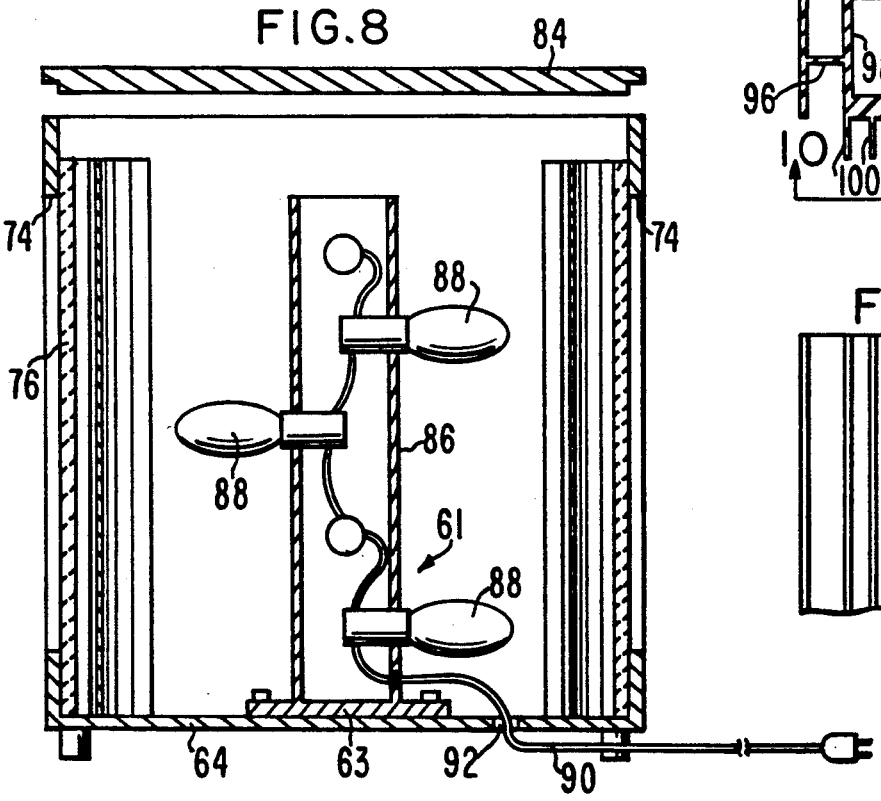
FIG. 8 is a cross-sectional view taken along line 8—8 of FIG. 7.

Another embodiment of the present invention is broadly denoted by the numeral 60 and includes a light box 62 having a bottom 64 and a number of sides walls 66, 68, 70 and 72 secured to and extending upwardly from the bottom 64 as shown in FIG. 8. Each of the sides of the light box 62 is provided with an opening 74 and each side has a transparent, two-way mirror 76 across the opening 74 thereof as shown in FIG. 8.

Each corner of light box 62 has a bracket or a holder 78 therein with each bracket 78 having some means for securing it in place in the corner of the light box. The exposed outer sides of each bracket 78 is provided with at least a pair of spaced, parallel, vertical grooves 80 for receiving the adjacent side marginal edge of a full mirror 82 for adjustable positioning of the mirror 82 in a position with respect to its corresponding transparent mirror 76. Each mirror 82 can be parallel with its transparent mirror 76 or it can be at an angle as shown in dashed lines for the mirror 82 adjacent to side wall 68 or as shown in full lines adjacent to side wall 72.

Light box 62 has an open top which can be closed by a lid 84 (FIG. 8). Moreover, the grooves 80 extend upwardly from the bottom of the light box and are open at the tops thereof so that mirrors 82 can be raised and lowered with respect to the grooves 80 to thereby position the mirrors 82 in desired locations adjacent to respective transparent mirrors 76.

Figure 7:
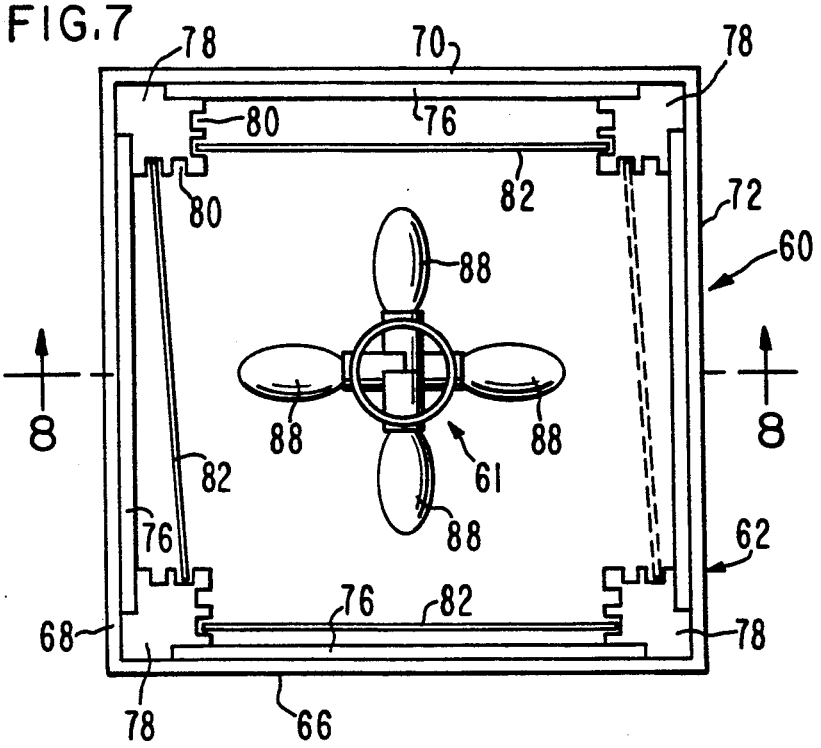
FIG. 7 is a view similar to FIG. 1 but showing a second embodiment of the light box of the present invention, the light box having a pair of mirrors for each of a plurality of sides of the box, respectively.

A light source 61 is located in light box 62 near the central portion thereof as shown in FIGS. 7 and 8. The light source can be of any suitable construction but, for purposes of illustration, it includes a non-conductive tube 86 mounted, in some suitable manner, such as by a base 63, on bottom 64 and extending upwardly from the bottom. Generally, tube 86 is equally spaced from all transparent mirrors 76, and tube 86 is provided with a number of light bulbs 88 which are located at suitable positions around the outer periphery of tube 86 at a convenient height. The light bulbs can be at different heights, if desired. Moreover, the light bulbs may be colored to give certain effects to designs whose multiple images are viewable through the mirrors 76 and 82 from locations outside the light box 62. An electrical conductor 90 is coupled to light bulbs 88 and extends through a hole 92 in the bottom 64 of the light box so as to couple the light box to a suitable source of electrical power.

Figure 9:
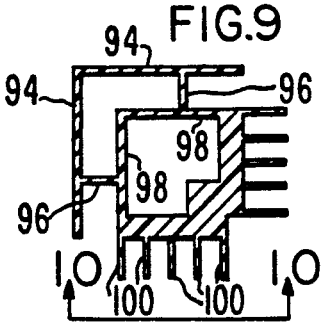
FIG. 9 is an enlarged top plan view of a holder for the side edge margins of the inner mirrors of the embodiment of FIGS. 7 and 8.
Figure 10:
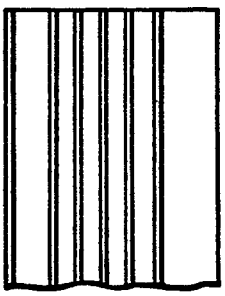
FIG. 10 is a side elevational view of the holder of FIG. 9, looking in the direction of line 10—10 of FIG. 9.

Each of holders or brackets 78 can be of any suitable construction. For purposes of illustration, each holder 78 can be an extrusion as shown in FIGS. 9 and 10 wherein the extrusion includes a pair of side strips 94 which can be secured to the inner surfaces of the adjacent side walls of the light box. Webs 96 couple strips 94 to a generally rectangular box-like element having side members 98 with spaced fingers 100 which project outwardly from the corresponding side surfaces of two of the side members 98 so that the spaces between the fingers form grooves which are adapted to removably receive the side marginal edges of corresponding full mirrors 82 as shown in FIG. 10.

Each mirror 82 has an innermost surface with a mirrored layer thereon provided with a particular design, such as the design shown in FIG. 5 for mirror 28.

The operation of light box 60 is the same as that of light box 10 of FIGS. 1 and 4. An observer looking into the sides of light box 60 will see multiple images of a particular design, and the designs of the various mirrors 82 can be the same or different from each other. Moreover, the images of designs will appear to be a straight line extending deeper into the light box 62 when mirrors 76 and 82 are parallel with each other. Also, the images of the designs will appear to be on a line which curves to the right or left when the inner mirror 82 is at an acute angle relative to the adjacent mirror 76 as described above with respect to light box 10. Thus, images of the designs will appear to be different in position depending upon whether the mirrors 82 are parallel with corresponding transparent mirrors 76 or are at acute angles with respect thereto.

A further embodiment of the present invention is broadly denoted by the numeral 110 and is shown in FIGS. 11 and 12. A light box 112 has sides 114, 116 and 118, sides 118 interconnecting the outer ends of sides 114 and 116 so that the light box has a triangular configuration. Sides 114 and 116 are provided with openings 120 therethrough across which are located a pair of a transparent mirrors 122 which are fixed in some suitable manner to the inner surface of respective side walls 114 and 116.

Holders 124 are provided at the corners of the light box, and the holders are provided with side grooves therein for removably mounting full mirrors 126 adjacent to respective transparent mirrors 122. The light box 112 has an open top to allow mirrors 126 to be adjusted as to the angles of mirrors 126 with respect to adjacent transparent mirrors 122. A lid (not shown) is used to cover the open top of the light box.

A light source 129 is located in the light box on the bottom 130 thereof. The light source includes a tube 132 having light bulbs 134 mounted thereon in some suitable arrangement.

Full mirrors 126 have mirror layers on the inner surfaces thereof, and such layers are provided with particular designs to be viewed. Thus, when light bulbs 124 are energized, an observer looking at a particular side of the light box 110 will see multiple images of a design. Depending upon the parallelism or angle of the corresponding full mirror 126 relative to its adjacent transparent mirror 122, the images of the design will appear to go deeply into the light box on a straight line or will appear to bend or curve to the right or to the left. Thus, the images of the design on each mirror 126 Will stimulate an observer to want to continue viewing the images for long periods of time.

FIGS. 13–15 show another embodiment of the present invention as used in the form of a clock. A light box 140 has a front side wall 142 provided with an opening 144 which is covered by a transparent, two-way mirror 146. Side wall 148, 150 and 152 and a top 153 are provided above a bottom 154. Means defining grooves 156 are provided on sides 148 and 152 as shown in FIG. 14 so that a full mirror 158 can be adjustably positioned with the side margins thereof in desired grooves 156.

The design etched into the rear mirrored face of full mirror 158 includes the four numerals shown in FIG. 15, namely the numerals 3, 6, 9 and 12 plus the circle inside the numerals. The hands of the clock will be mounted on suitable center shafts and driven by motor 160 between mirror 158 and a light source 162 which can take the form of a fluorescent bulb. The motor for the clock can be battery operated, and the clock dial can be seen in a multitude of images by an observer looking into the clock from exteriorly of side wall 142 of the light box. The clock images will appear to extend deeply into the light box if the mirror 158 is parallel to mirror 146. However, if mirror 158 is at an acute angle with respect to mirror 146, the clock will appear to bend to the right or to the left, depending upon the location of the side marginal edges of mirror 158 with respect to grooves 156.

Figure 16:
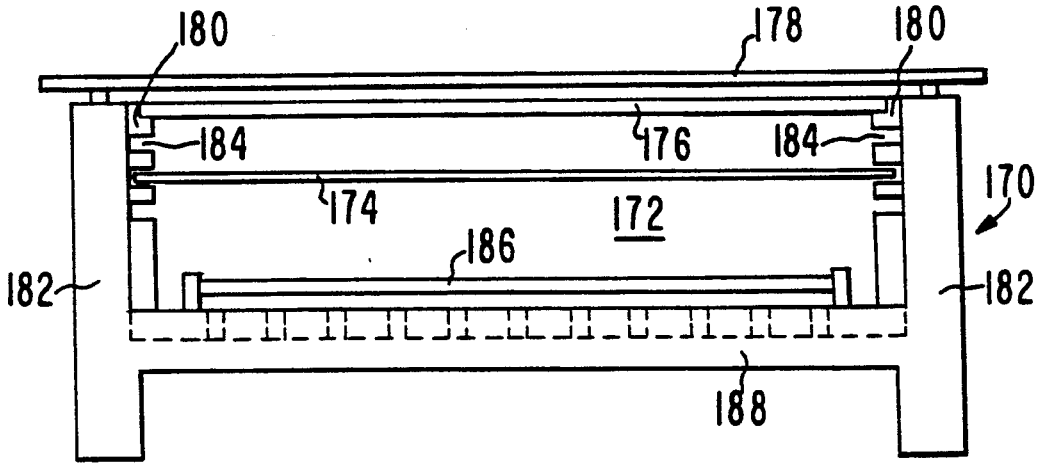
FIG. 16 is another embodiment of the light box of the present invention, the light box being in the form of a table.
Figure 17:
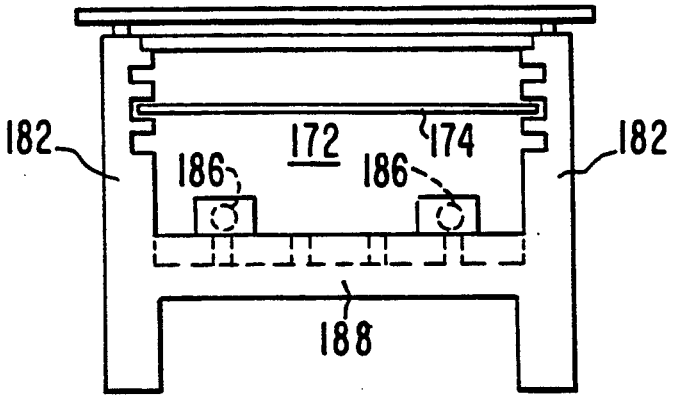
FIG. 17 is an end elevational view of the table of FIG. 16.

Another embodiment of the present invention is shown in FIGS. 16 and 17 and is in the form of a table 170 having an interior space 172 for receiving a first, full mirror 174 and a second transparent, two-way mirror 176 beneath a clear glass top panel 178. Holders 180 removably mount the ends of the transparent mirror 176 to table legs 182, and grooves 184 are formed in any suitable manner on the inner surfaces of the legs to receive the side marginal edges of full mirror 174. A pair of fluorescent light bulbs 186 are carried on a base 188 of table 170, and the interior 172 is enclosed in any suitable manner so that the light from the light bulbs 186 will be directed upwardly solely through the mirrors 174 and 176 in glass top 178.

The bottom surface of mirror 174 is provided with a suitable design which is to be viewed by looking downwardly through the clear glass top 178 and through transparent mirror 176. Thus, an observer will view a plurality of images of the design, and the images will appear to go down vertically if mirror 174 is parallel to mirror 176. If mirror 174 is at an acute angle with respect to mirror 176, the design features will appear to bend to the right or to the left, depending upon which side of the mirror 174 which is farther from mirror 176.

Figure 18:
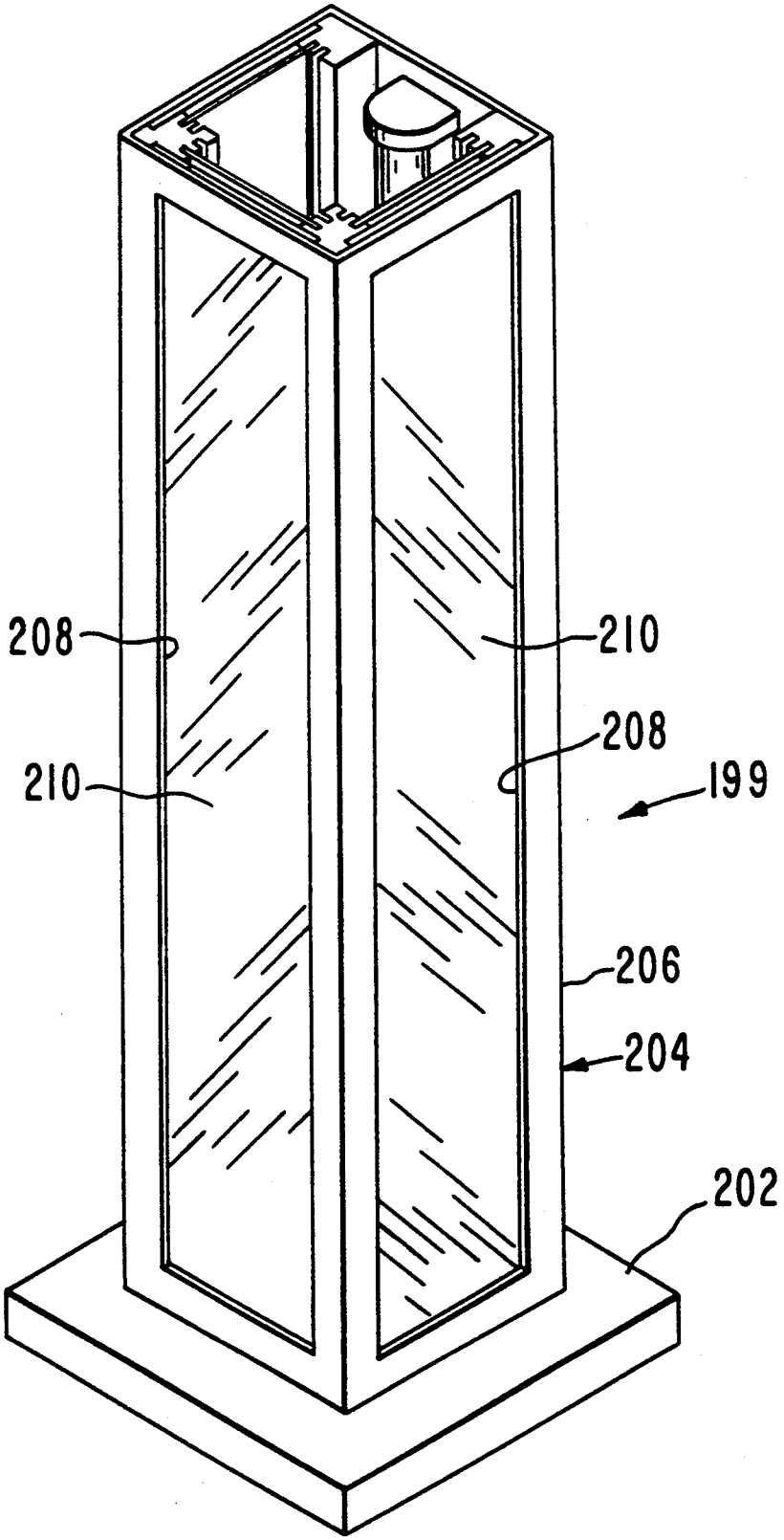
FIG. 18 is a light box in the form of an upright post or pedestal.

FIG. 18 shows another embodiment of the light box of the present invention in the form of a pedestal having an upper flat surface (not shown) and a base 202 for supporting a framework 204 in the form of a box 206 having openings 208 in several sides thereof. Transparent, two-way mirrors 210 are provided for light box 199 across the openings 208, and inner full mirrors (not shown) are provided within the space of the framework in spaced relationship to respective transparent mirror 210. A light source 214 in the form of a fluorescent bulb is in the light box and is mounted in any suitable manner. Holders (not shown) at the corners of the framework 204 have grooves for receiving the side marginal edges of the inner, full mirrors 212 so that the inner mirrors can be made parallel to the outer mirrors 210 or can be placed at an acute angle with respect thereto as described above for the other embodiments of the present invention. Thus, when light bulb 214 is energized, one can see the multiple images of various designs, depending upon the designs etched into the rear mirrored faces of the inner mirrors.

A vase or audio speaker can be placed on the top surface of the pedestal of FIG. 18.

I claim:

1. Apparatus for forming multiple light images comprising:

a light box having a first wall and a pair of spaced, parallel second walls adjacent to the first wall, said first wall being provided with an inner surface and a central opening therethrough;

A first, transparent mirror secured to the inner surface of the first wall and extending across said central opening thereof;

a second, opaque mirror having a thickness and a reflecting surface provided with a design formed therein, said second mirror having a pair of opposed marginal edges;

a plurality of spaced fixed ribs on each of the second walls respectively, the ribs on one of the second walls being aligned with the ribs on the other second wall, each pair of adjacent ribs of each said second wall defining an open end groove for removably receiving an adjacent marginal edge of the second mirror to thereby mount the second mirror in the light box in spaced relationship to the first mirror, there being at least two of the grooves on each of the second walls respectively, adjacent ribs on each of the second walls having a spacing therebetween and the spacing between said adjacent ribs of each of the second walls being greater than the thickness of the second mirror to permit the second mirror to be mounted in a location at an acute angle with respect to the first mirror; and a light source in the light box for directing light rays through the design and through the mirrors so that an image of the design will be reflected a number of times by the mirrors and such images will be observable through the central opening from a position exteriorly of the light box, the marginal edges of the second mirror being received in grooves which are aligned when the second mirror is parallel to the first mirror, the marginal edges of the second mirror being received in grooves which are out of alignment when the second mirror is at an acute angle relative to the first mirror.

2. Apparatus as set forth in claim 1, wherein said light box has an inner surface, a pair of brackets each including a mounting plate having a face provided with said ribs thereon, said mounting plate being secured to the inner surface of the light box.

3. Apparatus as set forth in claim 2, wherein said ribs are arranged so that the grooves formed by the ribs on one bracket are aligned with respective grooves formed by corresponding ribs on the other bracket.

4. Apparatus as set forth in claim 3, wherein the grooves are wide enough to receive the side margins of the second mirror when the second mirror is at any one of a number of acute angles with respect to the first mirror.

5. Apparatus as set forth in claim 1, wherein said means defining said plurality of ribs includes an extrusion having a plurality of spaced fingers thereon defining a plurality of grooves.

6. Apparatus as set forth in claim 1, wherein said design on the reflecting surface of the second mirror includes means defining a clock dial, there being shaft means, electric motor means and clock hand means carried by the second mirror.

7. Apparatus as set forth in claim 1, wherein said light box is in the form of an upright pedestal having an upper supporting surface thereon.

* * * * *